US005645463A

United States Patent [19]

Olsen

[11] Patent Number: 5,645,463

[45] Date of Patent: Jul. 8, 1997

[54] TOY BUILDING SET

[75] Inventor: Flemming Højberg Olsen, Espergærde, Denmark

[73] Assignee: Interlego AG, Baar, Switzerland

[21] Appl. No.: 232,251

[22] PCT Filed: Nov. 5, 1992

[86] PCT No.: PCT/DK92/00319

§ 371 Date: May 5, 1994

§ 102(e) Date: May 5, 1994

[87] PCT Pub. No.: WO93/08886

PCT Pub. Date: May 13, 1993

[30] Foreign Application Priority Data

Nov. 6, 1991 [DK] Denmark ..... 1828/91

[51] Int. Cl.[6] ..... A63H 33/12

[52] U.S. Cl. ..... 446/104; 446/123; 446/128

[58] Field of Search ..... 446/104, 102, 446/128, 123, 122, 124; D21/108

[56] References Cited

U.S. PATENT DOCUMENTS

| | | | |
|---|---|---|---|
| 4,606,732 | 8/1986 | Lyman | 446/120 |
| 4,789,369 | 12/1988 | Lyman | 446/128 X |
| 4,823,532 | 4/1989 | Westerburgen | 446/128 X |
| 4,886,477 | 12/1989 | Ziegler | 446/104 |
| 4,992,069 | 2/1991 | Bolli et al. | 446/128 |
| 5,259,803 | 11/1993 | Lyman | 446/128 X |

FOREIGN PATENT DOCUMENTS

| | | |
|---|---|---|
| 0085542 | 8/1983 | European Pat. Off. . |
| 9009828 | 9/1990 | WIPO . |
| 9009825 | 9/1990 | WIPO . |

*Primary Examiner*—Mickey Yu

*Attorney, Agent, or Firm*—Kane, Dalsimer, Sullivan, Kurucz, Levy, Eisele and Richard, LLP

[57] ABSTRACT

A toy building set has primary building members having a first type of coupling that includes studs and complementary parts for mating with the studs. The building set also includes secondary and tertiary building members. The secondary building members have elongated bodies and a second type of coupling including coupling faces that are at least partly rotational-symmetric about an axis transverse to the longitudinal direction of the body and coupling faces adapted to grip and receive the aforementioned coupling faces. The tertiary building members include a coupling of each of the primary and secondary types.

12 Claims, 8 Drawing Sheets

TOY BUILDING SET

BACKGROUND OF THE INVENTION

The invention concerns a toy building set comprising a plurality of interconnectible building elements of the type defined in the introductory portion of claim 1.

A plurality of toy building sets are known, consisting of box-shaped building elements with coupling studs on the upper side and complementary coupling means on the under-side. Toy building sets of this type have been marketed for a number of years under the name DUPLO® and are described cribed in the Danish Patent Specification 120 627. With building elements of this type it is possible to build compact and relatively simple structures, and these building elements therefore appeal to small children in particular.

As the children develop, they try to meet their needs with toy building sets making it possible to build more complex structures. A plurality of examples of toy building sets of this type are known, an example being the toy building set described in the European Patent Application EP-A-460 081 This toy building set consists of a plurality of elements which can be fixed mutually in a variable angle. A toy building set of this type will be suitable for building large and flexible structures which contain moving parts.

SUMMARY OF THE INVENTION

The object of the invention is to provide a toy building set which consists of a plurality of interconnectible building elements, making it possible to combine the advantages possessed by the box-shaped building elements having coupling studs with the flexibility possessed by the toy building set with rotatably interconnectible building elements.

This object is achieved in that the toy building set additionally comprises a third type of building element as stated in the characterizing portion of claim 1. An unpresidented flexibility of a toy building set is achieved hereby, it being possible to combine the compact structures that can be built with the first type of building elements with the flexible and movable structures that can be built with the second type of building elements. The toy building set comprises elements belonging to the primary as well as the tertiary type of building elements, and elements belonging to the secondary as well as the tertiary type of building elements.

In a preferred embodiment the third type of building element will be box-shaped, i.e. have a main body which corresponds to the main body of the first type of building element. The second type of coupling means form rotatable connections, where the axis of rotation of these connections is positioned outside the main body of the third type of building element. A particularly great movability between the elements can be achieved hereby, since they can e.g. rotate up to 270° with respect to each other.

Since very large and flexible structures can be obtained by interconnecting these two existing types of building elements, the third type of building element includes elements which, in addition to the coupling studs, are also formed with a screw by which the element of the third type can be fixed to another element having a complementary threaded hole. This screw is a supplement to the interconnection by means of coupling studs and complementary coupling means.

The invention provides various embodiments of the third type of building element, and these are described in the other subclaims.

The invention is unique in the shown embodiments in that the modular measures known from the first type of building elements are maintained in the interconnection in certain positions with the elements of the second and the third types. This applies both to the interconnection of the elements in elongation of each other and to the building of structures in the stacking direction.

The invention provides a toy building set by means of which it is possible to construct both small, compact and large, flexible structures.

The invention moreover concerns a building element for a toy building set, said building element being of the type defined in the introductory portion of claim 25. The building element is unique in that the coupling parts of the second set of coupling means are adapted for mutual interconnection by elastic movement of at least one coupling part, a locking device being provided for mutual fixing of the coupling parts by blocking of said elastic movement so that two coupled elements are rotatably interconnected. Thus, this element may be incorporated as a connection element between compact, box-shaped building elements with coupling studs and complementary coupling means—known under the name of DUPLO—and more markedly constructional building elements for building more complex structures. The building element defined in the claim may expediently be provided with wheels such that it serves as a vehicle bottom for building vehicles and the like.

The invention moreover concerns a second building element for a toy building set, said building element being of the type defined in the introductory portion of claim 27. This building element is unique in that it comprises a coupling part positioned at the end of a coupling part arm which extends obliquely from the transition between one end face of the box-shaped body of the building element and the side provided with coupling studs, such that the axis of rotation provided by the second set of coupling means is positioned outside the contour of the body. This element can be connected with a base of box-shaped building elements which just have coupling studs and complementary coupling means. With this element it is possible to start the building of flexible structures with construction building elements.

The invention additionally concerns a building element for a toy building set, said building element being of the type defined in the introductory portion of claim 28. The coupling part of the building element is here positioned at the end of a coupling arm extending from an opposite side with respect to the side provided with coupling studs, such that the axis of rotation formed by the second type of coupling means is positioned outside the contour of the body. With elements of this type it is possible to build a structure with box-shaped building elements which are just provided with coupling studs and complementary coupling means, where this structure rests on a base of construction building elements.

BRIEF DESCRIPTION OF THE DRAWINGS

The invention will be explained more fully below in connection with preferred embodiments and with reference to the drawing, in which.

DETAILED DESCRIPTION OF THE PREFERRED EMBODIMENT

Figure 1:
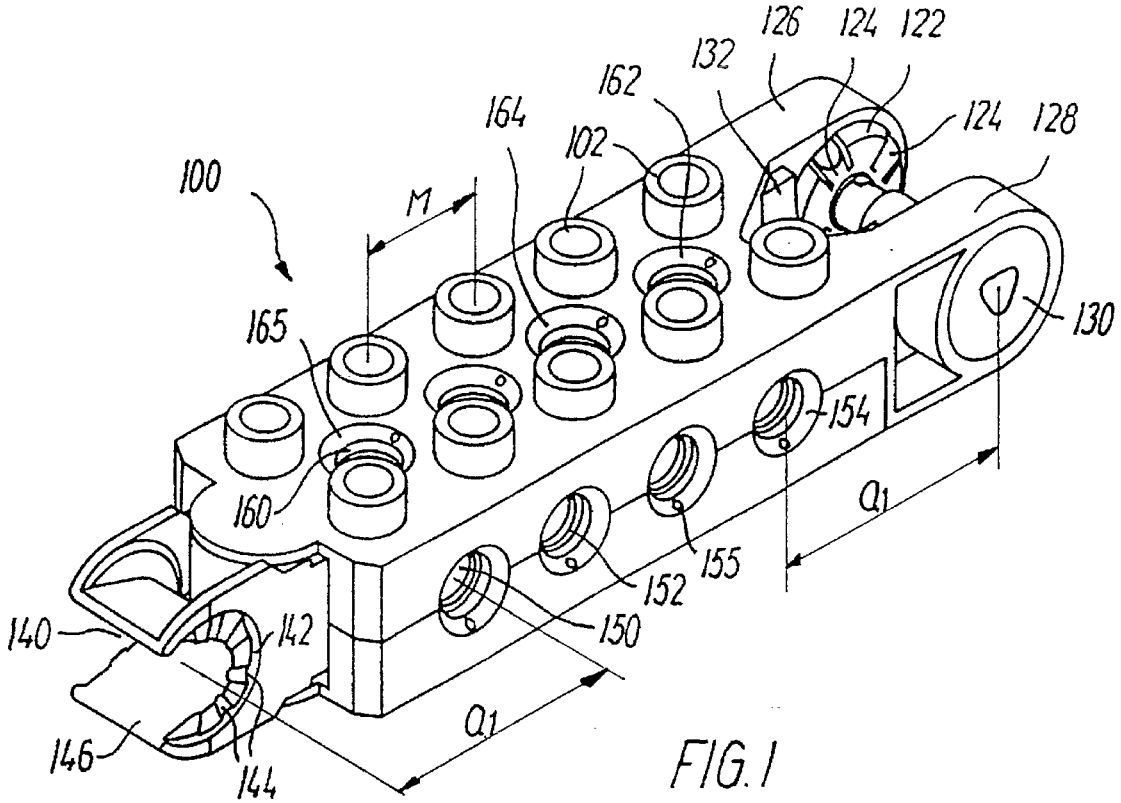
FIG. 1 is a perspective view of a preferred embodiment of a building element according to the invention.
Figure 2:
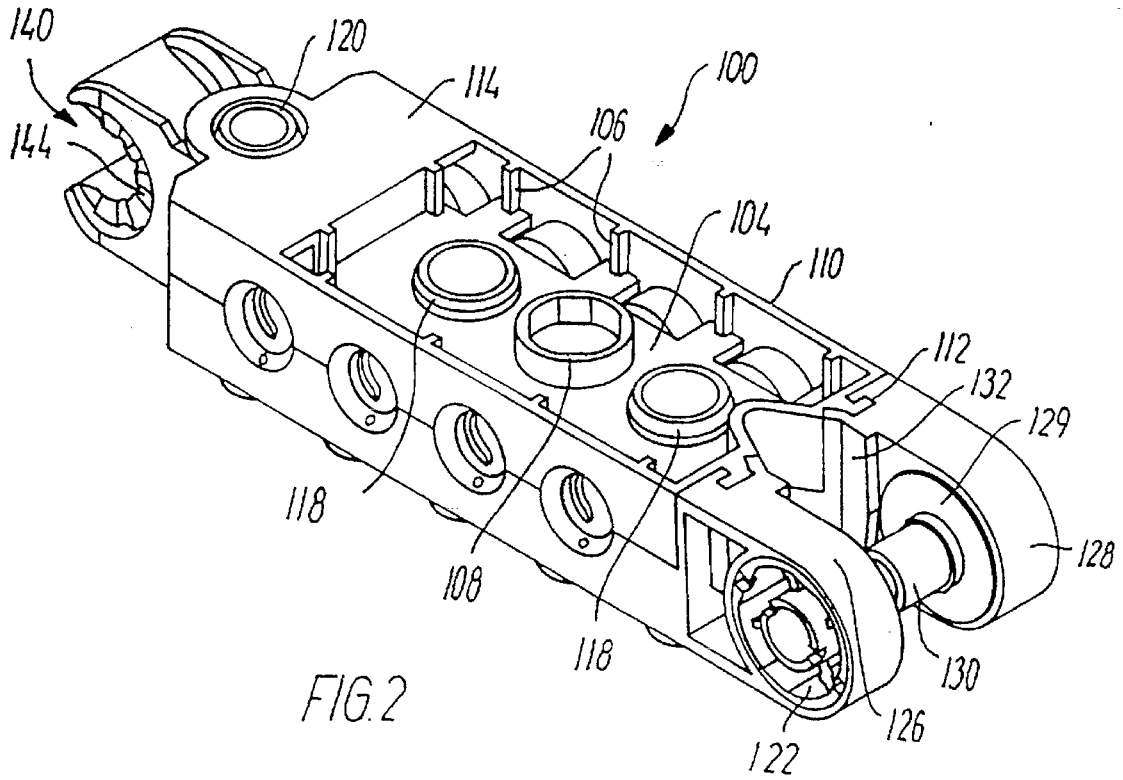
FIG. 2 is a bottom view of the building element shown in FIG. 1.

FIGS. 1 and 2 show a preferred embodiment of a building element for a toy building set according to the invention. The building element is generally designated by the reference numeral 100 and consists of a box-shaped body which has coupling studs 102 on the upper side in its preferred embodiment. Both the shape and the position of the coupling studs 102 are known per se, the coupling studs 102 being arranged in rows with a mutual modular distance M. FIG. 2 is a bottom view of the building element 100 and shows that the bottom 104 of the building element 100 is recessed with respect to the rim 110, rear end 112 and front end 114 of the building element. A plurality of projections 106 are provided interiorly along the edge 110, which, together with a number of cylinder tubes 108—here one—form complementary coupling means for receiving the coupling studs 102 of another element. The coupling studs 102 are received between the cylinder tube 108 and the projections 106 in a releaseable friction coupling in a manner known per se. In addition to the cylinder tube 108, two cylindrical projections 118 are shown, which are not necessarily included in the complementary coupling means because they serve a different purpose and merely constitute the termination of a cylinder tube extending therethrough. The same applies to a cylinder tube 120 in the front end 114 of the building element 100, since the through-going cylinder tubes 118, 120 are incorporated as locking means for irreversible interlocking of the individual components of the building element 100 upon assembly of this, which will be explained in connection with FIG. 3.

FIG. 1 shows a bushing 122 which is received non-releaseably in one fork arm 126 of the building element in the manufacture of said element. The bushing 122 has interior threads for a screw 130 which is received in the other fork arm 128 of the building element, likewise non-releaseably. The bushing 122 has a plurality of locking bosses 124 which are flexible in the axial direction of the screw 130. Together with a disc-shaped region 129 on the fork arm 128 the bushing 122 constitutes part of a coupling part in a second set of coupling means.

A coupling head 140, constituting the second coupling part of the second set of coupling means, is provided at the other end of the building element. This second coupling part has a partially circular coupling area 142 on each side of the coupling head 140. This coupling area 142 is open at one side, the coupling head 140 having a substantially wedge-shaped cut 146. The coupling head 140 is adapted to be received between the fork arms 126 and 128, the two circular coupling areas 142 of the coupling head being caused to contact corresponding coupling areas of the first coupling part in the form of the bushing 122 and the circular face 129. It will be seen that the circular engagement faces 142 are provided with a plurality of depressions 144 in which the locking flaps 124 of the bushing 122 can be retained. Two building elements are interconnected in that the coupling head 140 is received between the fork arms 126 and 128, which are bent away from each other by flexible movement. When the coupling head has been received between the fork arms 126 and 128, the flexible movement can be prevented by tightening the screw 130, whereby the two elements form a rotatable connection about the direction defined by the longitudinal axis of the screw. The rotatable movement between two building elements is limited by a stop 132, thereby eliminating the risk of a child getting its fingers squeezed between the two interconnected building elements. Between the rotatable connection and the centre of the closest coupling stud there will be a distance a1, which is preferably a whole multiple of half the modular distance M. The distance a1 is here one and a half times M for both ends.

In a preferred embodiment the coupling head 140 is rotatably journalled in the front end of the building element 100, with the cylinder tube 120 serving as an axis of rotation for this rotatable movement. This will be explained in connection with FIG. 3.

A plurality of holes 150 with interior threads 152 are provided along the sides of the building element 100. The holes 150 being adapted to receive the threaded section of a screw on a second building element incorporated in the toy building set. This building element may e.g. be a wheel so that the screw serves as a hub. As will be seen, the threaded hole 150 terminates in a conical section 154 which serves as a relief or transitional area for a corresponding conical section on the screw (not shown). The conical section 154 is moreover provided with two locking bosses 155 provided diametrically in the hole and adapted to engage corresponding, complementary recesses on the screw.

The upper side of the building element is formed with threaded holes 160 between the coupling studs arranged at a mutual modular distance, and these threaded holes 160, like the threaded holes 150 on the sides of the building element, have interior threads 162 and a conical section 164 with two diametrically provided locking bosses 165. The threaded holes 160 are provided in the intersection point of the diagonals for a square formed by four adjacent coupling studs 102. This means that the threaded holes 160, follow the same mutual modular distance M as the coupling studs 102. The same applies to the threaded holes 150, since they are disposed opposite the threaded holes 160 and thereby centrally between the coupling studs 102 in the shown embodiment. In the shown embodiment, the building element has five coupling studs 102 arranged in pairs and thereby four threaded holes 160. There will thus also be four threaded holes 150 on each side of the building element. The building element 100 may e.g. serve as a vehicle bottom, and if the length of the building element 100 is increased, it may be expedient to omit individual pairs of wheels 150, because it is not possible to attach wheels in two adjacent holes anyhow.

Figure 3:
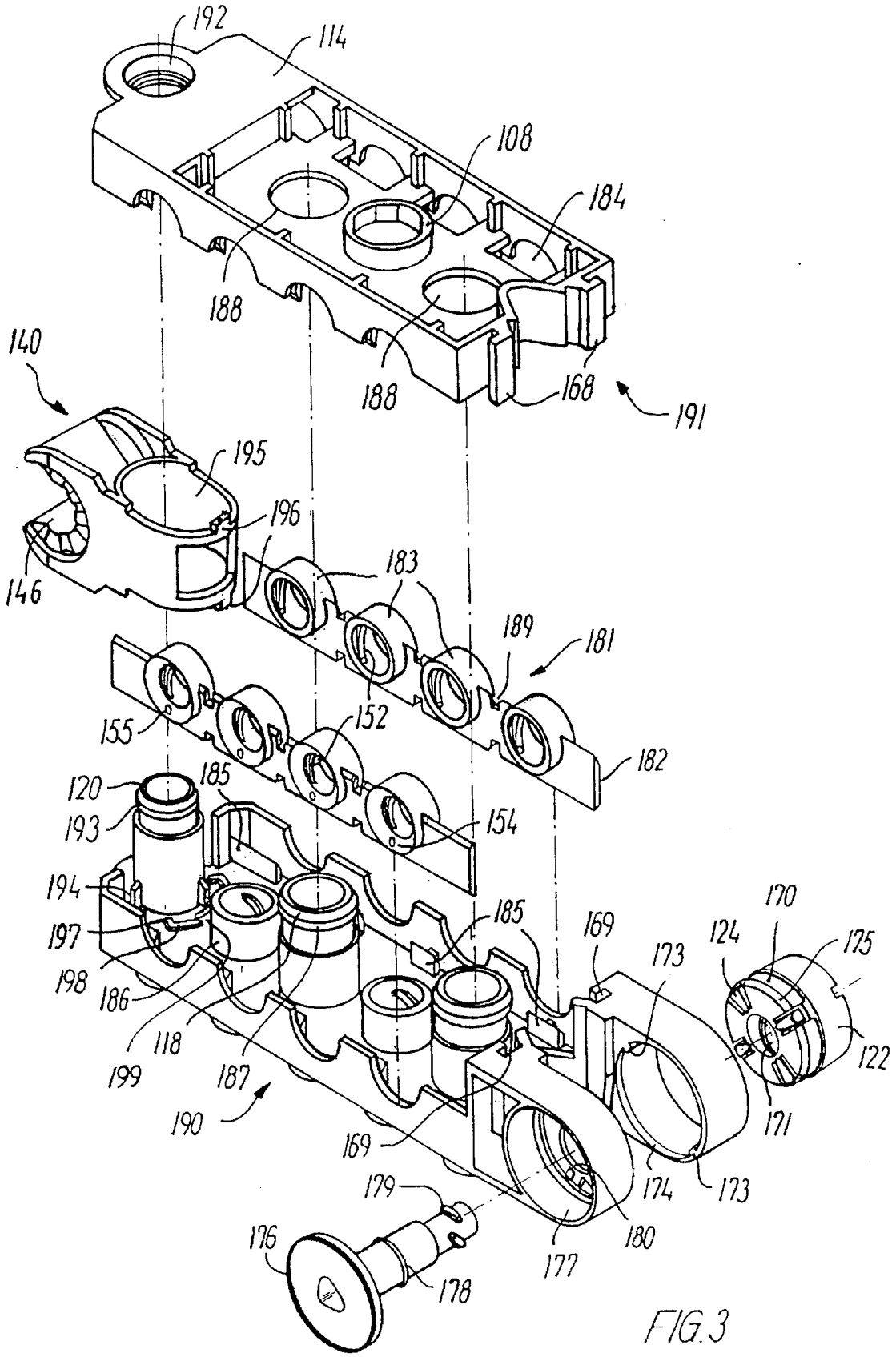
FIG. 3 is an exploded view of the components incorporated in the building element shown in FIG. 1.

FIG. 3 shows the building element of FIGS. 1 and 2 separated in its individual components. It will be seen that the bushing 122 (see FIG. 1) has two coaxially positioned bushing tubes, the inner one of which having interior threads 171, the outer one having an annular locking groove 170 which terminates in a conical collar 175. It will moreover be seen that the locking bosses 124 of the bushing are contiguous with the bushing at the root of the bosses so that these extend freely resiliently outwards in a radial direction. It will be seen that one of the fork arms of the element is provided with a hole to receive the bushing, said hole being formed with a guide 173 in the radial direction of the bushing so that these guides 173 can be received in grooves (not shown) in the bushing 122. The bushing is fixed hereby during the subsequent use. At the end of the opening of the fork arm there is moreover provided a locking ring 174 which is adapted to cooperate with the locking groove 170 upon mounting of the bushing 122. Like the collar 175, the locking groove 174 is formed with a conical guide face so that the bushing 122 can be correctly positioned using a relatively small force in the mounting of the bushing, while it is not possible in practice to remove the bushing 122 without destroying the parts. Thus, an even very strong mutual engagement is provided since the locking ring 174 and the conical collar 175 serve as barbs.

The screw 130 has a head 176 from which a shank extends. The shank is formed with a bead 178 which is asymmetric so that it has a guide face and a stop face. The stop face is formed by a stepwise increase in the diameter of the shank, while the guide face is conical. The shank end facing away from the screw head 176 is provided with threads 179. The other fork arm of the element is provided with a hole having an interior cylinder face 177 which terminates at the end in a ring-shaped disc at a circular opening 180. When the screw is to be mounted, the threaded end is inserted through the hole 180, and then the bead 178 is caused to pass the opening 180, which can be done because of the guide face of the bead, while the stop face prevents withdrawal of the screw 130. When the screw has been mounted in the hole of the fork arm, it can be moved longitudinally between two extreme positions. In one extreme position the bead 178 engages the area around the hole 180, where the screw head 176 in this position is approximately flush with the outer side of the fork arm. In the other extreme position the screw head 176 has been moved right down to the bottom of the hole 177 and engages the disc-shaped part. This travel is provided by screwing the screw into and out of the bushing 10, respectively. The screw 130 can advantageously be so short that it does not protrude beyond the contour of the element at any time.

FIG. 3 moreover shows that the element 100 comprises two uniform threaded beams 181, each of which comprises a plurality of bushings 183 (here four) with interior threads 152, the bushings 183 being integral with a carrier beam 182 with a plurality of guide grooves 189. The bushings 183 form the threaded holes 150 shown in FIGS. 1 and 2, the bushings being therefore formed with a conical section 154 having two diametrically positioned locking bosses 155. It will be seen that the carrier beam 182 is tapered along its edges to facilitate mounting in the retaining grooves 185 provided in the upper part 190 (in the position shown in FIG. 1) the element. The lower part 191 has correponding retaining grooves, which, however, do not appear from the drawing. The edges on the upper part 190 and the lower part 191, respectively, are rounded so that the edges are caused to engage the bushings 183 quite tightly, which are thus caused to be flush with the side faces of the element 100. Some of the threaded holes 160 mentioned in connection with FIG. 1 are provided by bushings 186, which have interior threads, and which are integral with the upper part 190. Others of the holes 160 are provided by a through-going cylinder tube 118, which likewise has interior threads and are integral with the upper part 190, but are moverover formed with a locking bead 187 which can be received in a complementary opening 188 on the lower part 191. The locking bead 187 has a guide face facilitating mounting, and a stop face preventing subsequent separation of the upper part 190 and the lower part 191. It will be seen that the shown element has two through-going cylinder tubes 118 as well as an additional cylinder tube 120. The cylinder tube 120 likewise has a locking ring at the end by which it can be locked to a hole 192 in the lower part 190, the hole 192 having a recessed locking bead and being adapted to receive the end of the cylinder tube 120, so that the locking bead provided on the cylinder tube 120 is received in the hole 192 and is retained. Coupling between the upper part 190 and the lower part 191 via the three cylinder tubes 118, 120 provides a very safe and strong locking of the element 100. This locking is additionally intensified by the provision of two grooves 168 in the upper part 191 which are adapted to be received in the two guides 169 in the upper part 190. The groove 168 and the guide 169 moreover provide for reinforcement of the fork arms 126 and 128. Further, the lower part 191 is provided with a plurality of holes along the edges to receive the bushings 183. This also appears from FIG. 2.

The coupling head 140 has a ring-shaped holding part 195 with an oval channel extending therethrough. This oval channel is provided with a front wall and a rear wall having the same radius of curvature, but the centers of the two radii of curvature are offset so that the channel is oval. A plurality of guides 194 (here four) are provided at the foot of the cylinder tube 120, which are adapted to engage the inner side of the ring-shaped holding part such that these in practice define the movements of the coupling head 140. Corresponding guides may be provided along the entire length of the cylinder tube 120 up to directly below the locking bead 193. It will moreover be seen that the coupling head 140 is provided with locking pins 196 which are adapted to cooperate with a guide rail 198 provided behind the cylinder tube 120, it being possible to move the locking pins within the circle portion defined by the guide rail 198 with the locking grooves 197. It will be seen that a guide 199 is provided in the center of the guide rail 198. Corresponding guide grooves are of course also provided on the lower part 191 of the element. When the locking pin 196 is moved along the guide rail 198, the coupling head is pulled slightly forward, so that the rear wall of the ring-shaped holding part engages the guide 194 facing the bushing 186. In this position the coupling head can freely rotate between two extreme positions, the locking pins 194 being movable between the locking grooves 197. When the coupling head 140 is directed straight forward and is moved rearwardly, the locking pins 196 are received in the guides 199, whereby it is retained in a stable position. This is expedient in particular when the element is to be coupled with another element via the coupling head 140.

Figure 4:
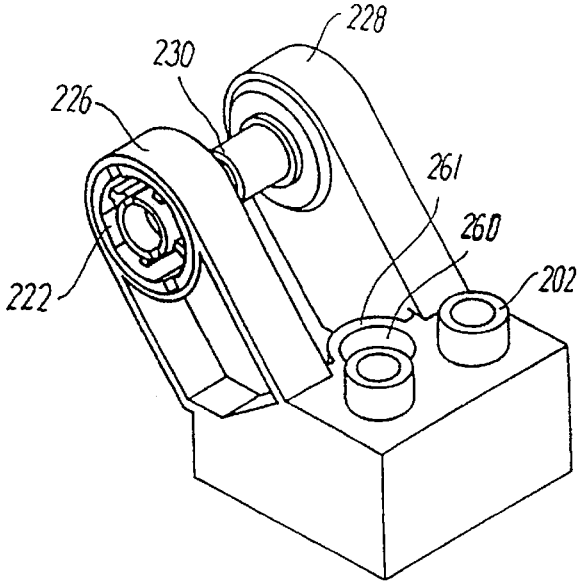
FIG. 4 is a perspective view of a preferred embodiment of a second building element according to the invention.
Figure 5:
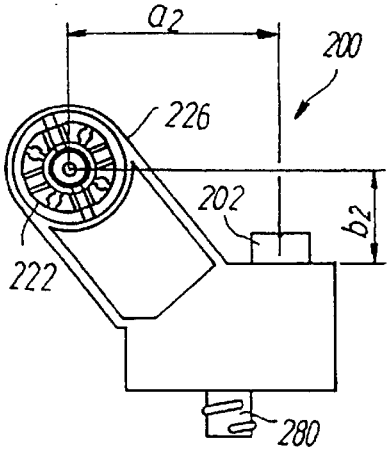
FIG. 5 is a side view of the building element shown in FIG. 4.
Figure 6:
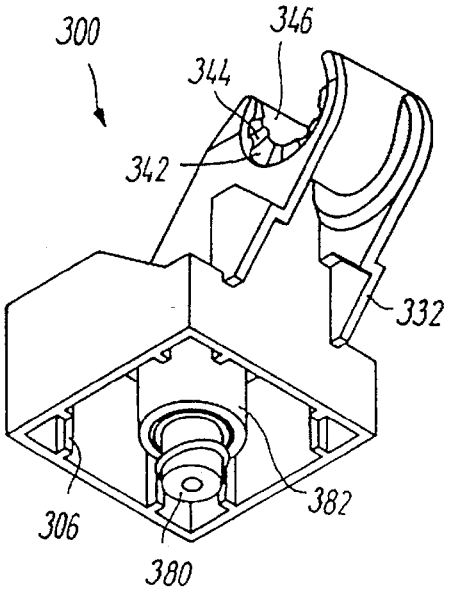
FIG. 6 is a perspective view of a preferred embodiment of a third building element according to the invention.
Figure 7:
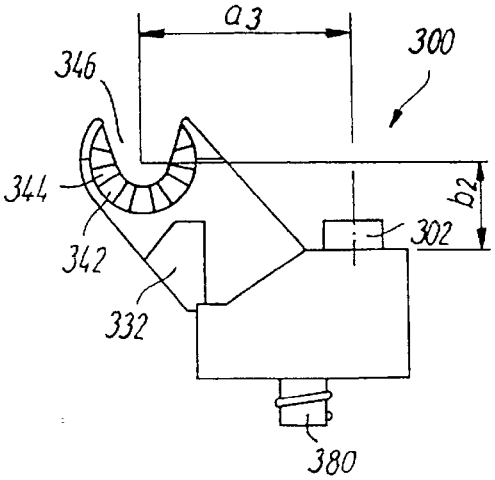
FIG. 7 is a side view of the building element shown in FIG 6.

FIGS. 4 and 5 show a second embodiment of a building element for a toy building set according to the invention. This building element is generally designated by the reference numeral 200, and it will be seen that the building element 200 has a box-shaped main body with a square cross-section- FIGS. 6 and 7 show a third embodiment of a building element for a toy building set according to the invention, where this building element is generally designated by the reference numeral 300.

It will be seen that the building element 200 has coupling studs 202 by means of which it can be interconnected with other parts incorporated in the toy building set. In addition, the building element 200 will also be provided with complementary coupling means on the underside, corresponding to those shown in FIG. 6, by means of which it may e.g. be interconnected with the coupling studs 102 of the building element 100 shown in FIG. 1. As explained before, this interconnection will be purely frictional, and the building element 200 is therefore also provided with a screw 280 by means of which the frictional interconnection can be reinforced. The screw 280 will be provided with an annular bead so that the screw 280 can be moved in its axial direction between two extreme positions, where in one extreme position it is positioned entirely within the contours of the building element 200, and in the other extreme position it is positioned as shown in FIG. 5. It will thus be possible to arrange the element 200 on elements without threaded holes as well as on elements with threaded holes 160 (FIG. 1).

The building element 200 is fixed with respect to the building element shown in FIG. 1 by being caused to engage the coupling studs 102 releaseably and frictionally, following which the screw 280 is tightened with a tool provided for the purpose. This tool may e.g. have the shape of a screwdriver with a triangular end profile corresponding to the screw 130 shown in FIG. 1. The tool will not be described in further detail. As shown in FIG. 4, the building element will e.g. have a recess in connection with the second type of coupling means, so that the rear wall 261 of the threaded hole 260 corresponds to the outer wall of the element. The flexibility of the fork arms 226 and 228 will hereby be increased. Like the element shown in FIG. 1, the first coupling part in the second coupling means will be positioned on two form arms 226 and 228. A bushing 222 corresponding to the bushing 122 is non-releaseably arranged in a complementary hole in the fork arm 226, while a screw 230 corresponding to the screw 130 is arranged in an opening in the form arm 228, likewise non-releaseably. The function of this coupling part corresponds to the function of the coupling part shown in FIG. 1.

The axis of rotation defined by the coupling part shown in FIGS. 4 and 5 will be positioned at a distance a2 from the center of the coupling studs 202, the distance a2 being measured in parallel with the surface of the element 200 and corresponding to one and a half modular distances M.

FIGS. 6 and 7 shows the building element 300 which may be considered as being complementary to the building element 200 shown in FIGS. 4 and 5, since it is provided with a coupling head 340 for coupling with the second coupling type coupling part of the building element 200. The coupling head 340 has a wedge-shaped cut 346 and a partially circular coupling area 342 with a plurality of depressions 344. The coupling head 340 is positioned on a coupling arm extending obliquely upwardly from one side of the element 300. The coupling arm is provided with a stop 332 which, when the element 300 is interconnected with a second element via the coupling head 340, limits the rotatable movement provided hereby. With respect to the coupling studs 302, the element 300 has complementary coupling means in the bottom, said coupling means being formed by projections 306 and a centrally arranged cylinder tube 382. The coupling studs of a second element can thus be received frictionally between the projections 306 and the cylinder tube 382. The cylinder tube 382 can advantageously have a length such that, when the element 300 is interconnected with a second element, it just touches the surface of this second element, so that no tensions will arise when the screw 380 of the element 300 is tightened. The function of the screw 380 corresponds to the function of the screw 280. Here too, the axis of rotation of the coupling head 340 will be positioned at a distance a3 from the center of the coupling stud 302, and this distance a3 corresponds to one and a half times the modular distance M of the coupling studs 302. The axis of rotation will likewise be positioned at a distance b3 from the upper side of the element 300, the distance b3 corresponding to the height of the coupling stud 302 added to half the height of the box-shaped body of the element 300. The building element 300 has so far been described as being an element with an obliquely upwardly protruding coupling arm, but a skilled person will appreciate that in another embodiment it may have an obliquely downwardly protruding coupling arm. The element may then have four coupling studs on the upper side, while on the underside it may be adapted to receive two coupling studs. The same observation may be made with respect to the building element 400 shown in FIGS. 8 and 9.

Figure 8:
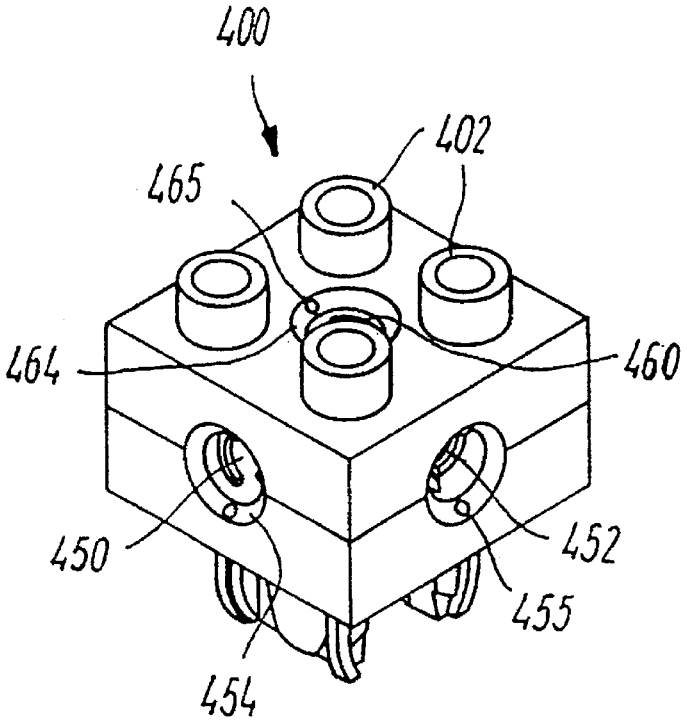
FIG. 8 shows a preferred embodiment of a fourth building element according to the invention.
Figure 9:
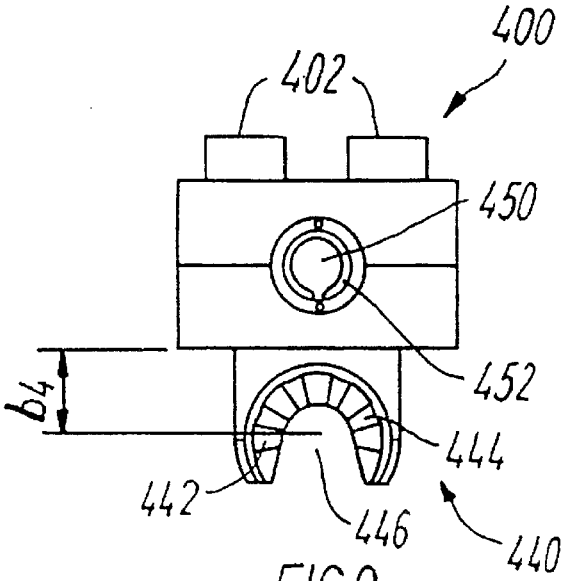
FIG. 9 is a side view of the building element shown in FIG. 8.

FIGS. 8 and 9 show a fourth embodiment of a building element according to the invention, said building element being generally designated by the reference numeral 400. The building element 400 comprises a box-shaped body with coupling studs 402 on the upper side. The building element 400 has no coupling means complementary with the coupling studs 402, but has a coupling head 440 instead which is integral with the underside of the element. In the intersection point of the diagonals for the square formed by the coupling studs 402, a threaded hole 460 with interior threads and a conical termination 464 with two locking bosses 465 is provided. Centrally in each of the side faces the building element 400 has respective threaded holes 450 with interior threads 452, the holes being terminated with a conical section 454 with two diametrically positioned locking bosses 455. Like the element shown in FIGS. 1–3, these threaded holes 450 are provided with loose inserts which are mounted prior to the assembly of the element. The upper and lower halves of the element can be snapped together, the threaded hole 460 continuing in a cylinder tube which is downwardly terminated with snap means which can be caused to non-releaseably engage complementary snap means on the lower part of the element. However, these features are not shown in the drawing, but a skilled person will be able to understand the principle on the basis of FIG. 3. The cylinder tube, extending from the threaded hole 460, may be through-going so that it terminates in the wedge-shaped cut 446 of the coupling head 440. It will hereby be possible for the element 400 to receive a threaded shaft so that said shaft extends from the upper side as well as the underside of the element 400. Like the coupling head shown in FIG. 1, the coupling head 440 has a coupling area 442 which is provided with a plurality of depressions 444.

A skilled person will appreciate that the toy building set of the invention can be supplemented with a building element complementary to the building element 400 shown in FIGS. 8 and 9, the coupling head 440 on the underside of the element being replaced by the first half of a second type of coupling means which consists of protruding fork arms. This first half, like the coupling head 440, may be positioned such as to extend perpendicularly from the underside of the element. Alternatively, the second type of coupling means may extend perpendicularly from the upper side of the building element, while the underside of the element is then constructed as shown in FIG. 6.

In the preferred embodiment, the axis of rotation formed with the coupling head 440 will be positioned at a distance b4 from the lower edge of the building element corresponding to half the height of the box-shaped body of the building element. The element 400 can hereby be interconnected with the element 100 so that it can be incorporated in a structure with traditional building elements where their modular measures are maintained.

Figure 10:
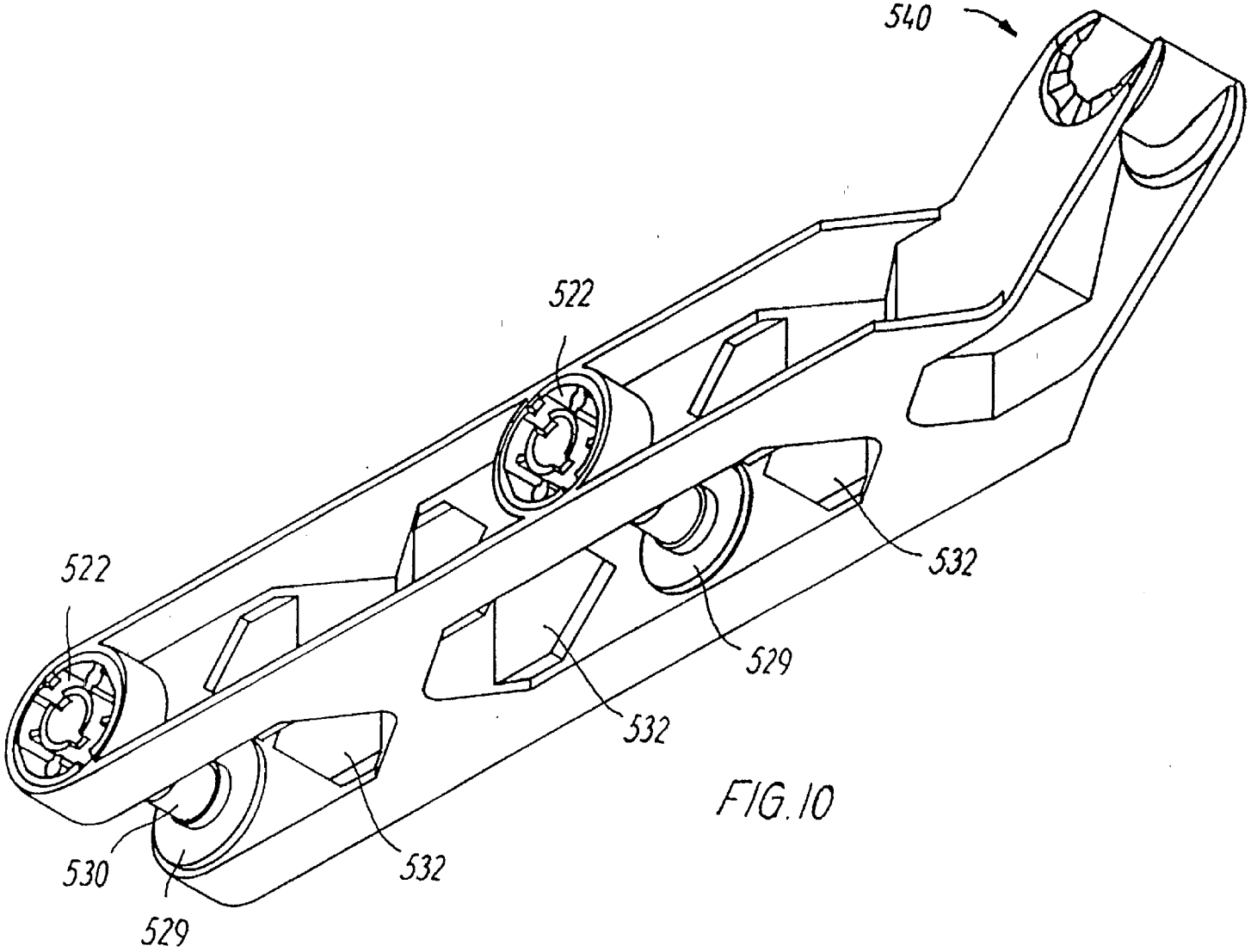
FIG. 10 is a perspective view of an embodiment of a building element for use in a toy building set according to the invention.
Figure 11:
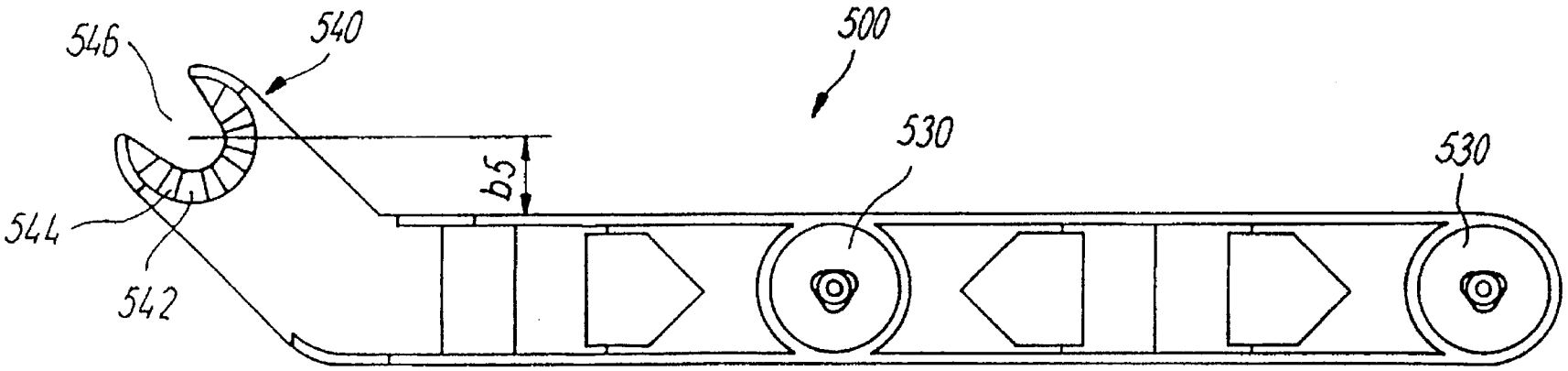
FIG. 11 is a side view of the building element shown in FIG. 10.

FIGS. 10 and 11 show a preferred embodiment of a second type of building element for use in the toy building set of the invention. This building element is not provided with coupling studs or coupling means complementary with these, but just comprises coupling means of a second type. As will be seen from the figure, the element is generally designated by the reference numeral 500 and it has a coupling head 540 at one end, said coupling head corresponding to the through-going coupling head shown in FIG. 1 and having a wedge-shaped cut 546 and a coupling area 542 with depressions 544. At its other end the building element 500 has a coupling part complementary to the coupling head 540, said coupling part comprising a bushing 522 which is secured in one fork arm of the building element, while a screw 560 is journalled in the other fork arm. The coupling part complementary to the coupling head is formed by the inwardly directed face of the bushing 522 and the disc-shaped face 529. In addition, the element has a second coupling part which is complementary with the coupling head 540 and is arranged centrally in the building element 500. Flexibility is provided to the coupling part in that the coupling part is arranged centrally on two bridge sections having a relatively long free span. The flexibility of this coupling part will be somewhat smaller than that of the coupling part arranged on the fork arms, but it will be fully sufficient for achieving the desired function. As will be seen from the figures, the coupling head 540 is arranged on an arm forming an angle with the rest of the building element 500. The axis of rotation define by the coupling head 540 will therefore be positioned at a distance b5, corresponding to half the height of the elements 100, 200, 300 and 400 without coupling studs, as well as to half the thickness of the element 500. The distance from the axis of rotation defined with the coupling head 540 and the axes of rotation defined with the screws 530 will hereby correspond to precisely the height of one of the mentioned elements.

Figure 12:
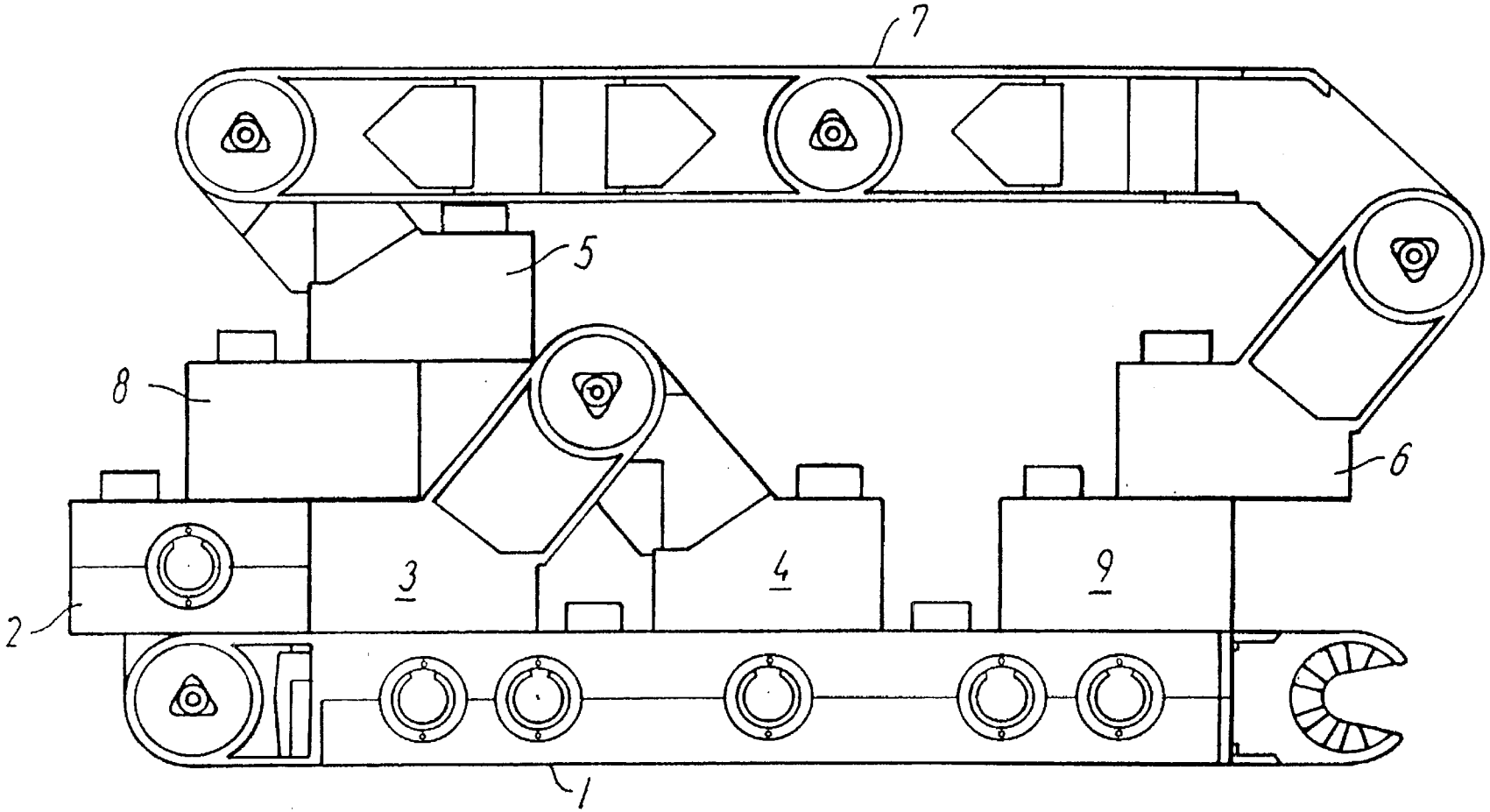
FIG. 12 shows a structure built with building elements from a toy building set according to the invention.

FIG. 12 shows a structure built with elements of the type which are described above. An element 1 forms the base of the structure, and it will be seen that this element substantially corresponds to the element 100 shown in FIGS. 1–3, but the element 1 is longer however, having eight pairs of coupling studs (101, FIG. 1). It will moreover be seen that some of the threaded holes (150, FIG. 1) are omitted. Nevertheless, the threaded holes maintain the modular distance m, the distance between two threaded holes in this embodiment being either one time or two times the modular distance m.

A building element 2 corresponding to the building element 400 shown in FIGS. 8 and 9 is coupled via its coupling head (440, FIG. 9) with the building element 1 via the coupling means which are provided thereon and are complementary to the coupling head on the element 2. A building element 3, corresponding to the building element 200 shown in FIGS. 4 and 5, is secured on the building element 1 at the side of the building element 2. This attachment is established by frictional coupling between the coupling studs (102, FIG. 1) of the building element 1 and the corresponding complementary coupling means at the bottom of the element 3. This element 3 is moreover coupled with an element 4 via the second type of coupling means. The element 4 is simultaneously coupled to the base element 1 by friction, said coupling being established by means of frictional coupling between the coupling studs on the element 1 and the complementary coupling means in the bottom of the element 4. It should be noted that the coupling established by the second type of coupling means permits coupling of the elements 2 and 3 with a base plate—here the element 1—in a manner such that the modular measures of the toy building set are observed. It will be seen that the elements 3 and 4 are coupled via the coupling means of the second type to provide a gap between the elements corresponding to precisely a modular measure. It will moreover be seen that the upper sides of the elements 2 and 3 likewise observe the modular measures so that a building element 8, which is box-shaped and Just has building studs on the upper side and complementary coupling means on the underside, can be coupled with the coupling studs (402, FIG. 8; 202, FIG. 4) on the elements 2 and 3, which takes place frictionally, as described above. A building element corresponding to the element 300 shown in FIGS. 6 and 7 is provided on the element 8.

At the other end of the element 1 there is provided a building element 9, which corresponds to the element 8 and is coupled with an element 6 corresponding to the building element 200 shown in FIGS. 4 and 5, the element 9 being coupled with the elements 1 and 6 via frictional coupling. As will be seen, the structure shown in FIG. 12 comprises an additional element 7 corresponding to the element 500 shown in FIGS. 10 and 11. As explained before, this element just comprises coupling means of the second type and receives and retains at its one end the coupling head on the building element 5. The coupling head of the building element 7 is received and retained in corresponding manner by the coupling means of the building element 6 which are complementary to the coupling head. It will be seen that the body of the building element 7 extends in parallel with the body of the building element 1. It is clear of course that the screws in the elements 3 and 4 can be tightened to reinforce the frictional coupling with the element 1. Corresponding tightenings can be affected with the previously mentioned screws to counteract the flexibility of the fork arms. An extremely stable structure can be achieved hereby, the shown structure being just included to illustrate the modular measure of the building set.

The invention has been described above in connection with preferred embodiments, and a plurality of modifications of the shown structures can therefore be made. Thus, nothing prevents the coupling studs and the complementary coupling means from being positioned at other points than on the upper side and underside of the building elements. Strictly speaking it is not even necessary that these coupling means are arranged on two opposed sides, and actually they can be arranged on two adjoining sides. However, this will often be considered inexpedient since the play value of the toy building set is considered to be greatest precisely when it is possible to stack the individual elements.

The second type of coupling means have been explained above in connection with a relatively stiff coupling head, the snap coupling having been provided by flexible fork arms. However, nothing prevents the fork arms from being made more stiff, while the coupling head is made more flexible. This may be done e.g. by cutting through the coupling head longitudinally so that the coupling areas (142, FIG. 1) can be moved toward each other in a flexible movement. When coupling has been established, the flexible movement may be fixed by placing a wedge in the cut. Thus, the invention is not restricted to the shown embodiment alone. Actually, also conceivable is an embodiment where the coupling head (140 in FIG. 1) is adapted to grip a shaft part between the fork arms of a second element. Coupling of this type can also be established by snap effect The shown embodiments have been explained in connection with the modular measure of the toy building set, but nothing prevents the elements of the invention from being embodied without modular measures. This, however, will reduce the usefulnes of the overall concept. Correspondingly, the axis of rotation of the second type of coupling means may be positioned at other distances from the individual elements, it being also possible at other distances to maintain the mutual modular measure of the elements. However, at the present time it is preferred to make the tertiary elements 100, 200, 300 and 400 as compact as possible, i.e. make the arm on which the coupling head is mounted as short as possible and make the fork arms as short as possible. The flexible and movable structures are then provided with the secondary building elemens corresponding to the building element 500.

Figure 13:
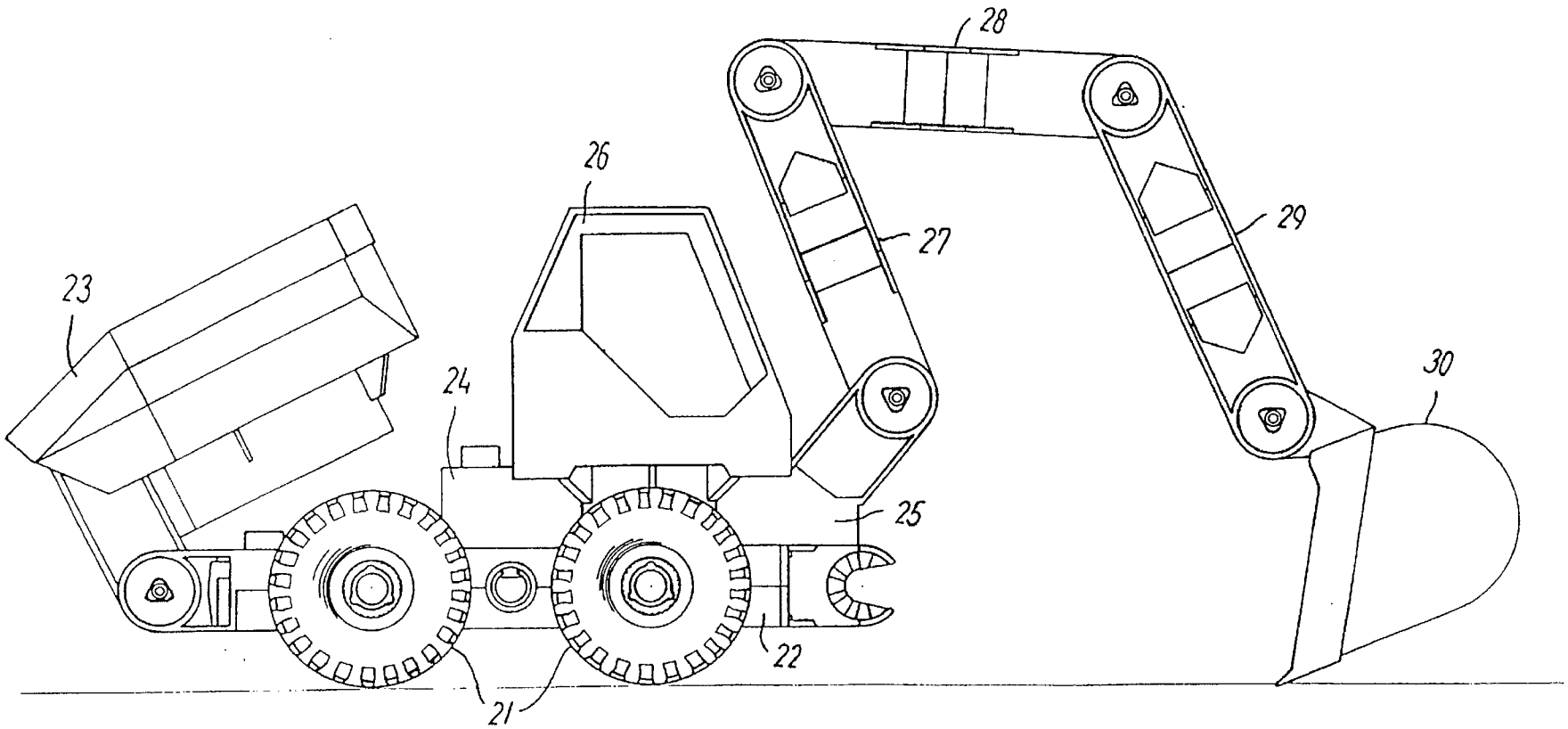
FIG. 13 shows another structure built with building elements from a toy building set according to the invention.

FIG. 13 shows a structure built with elements according to the invention. An element 22, which corresponds to the element 1 shown in FIG. 12, is provided with four wheels 21, which are screwed into threaded holes (150 in FIG. 1) formed along the sides of the element 22. The coupling part, formed with the fork arms, at one end of the element 22 receives a coupling head on a tiltable platform 23. This reception takes place as described above. The tiltable platform 23 can be tilted from a position in which the lower part engages the surface of the element 22, to a position in which the contents of the platform 23 are discharged. Three more elements are secured to the element 22 by means of frictional coupling. One of these elements 24 is an element known per se, which is box-shaped and has coupling studs on the upper side and complementary coupling means in the bottom. A second element 25 corresponds to the element 200 shown in FIGS. 4 and 5, it having fork arms extending obliquely upwardly and being adapted to receive a coupling head on a second element. These two elements 24 and 25 in combination with the element 22 form a base for the third one of the elements—viz. the element 26 which serves as a cab, said element being actually just an element corresponding to the element 24 with a super-structure in the form of the cab. The element 26 can advantageously be provided with a screw corresponding to the screws 230 and 330 shown in FIGS. 4–7, whereby the frictional attachment is reinforced. The coupling part on the element 25 receives a coupling head on a second element 27, which essentially corresponds to the element 500 shown in FIGS. 8 and 9, but is shorter however. The element 27 has a coupling head at its one end and a complementary coupling part at its other end. The second coupling part on the element 27 is adapted to receive a coupling head on a second element 28, which has the same length as the element 27, but has coupling heads at both ends. An element 29 receives the second one of the coupling heads on the element 28, said element having the same length as the elements 27 and 28. However, this element 29 has no coupling heads, but on the other hand two complementary coupling parts. The second coupling part on the element 29 receives a coupling head on a building element 30 having the shape of a bucket on an excavator. The elements 27, 28 and 29 constitute a movable connection by which a child during its play with a toy building set can perform digging movements with the bucket 30. It is clear that the elements 28 and 29 can be replaced by two elements corresponding to the element 27.

I claim:

1. A toy building set comprising:

box-shaped toy building elements of a first type, each of said first type of building element including a first type of coupling means comprising coupling studs on an outer surface thereof and recesses for receiving coupling studs on another surface thereof, whereby elements of said first type can be releasably stacked with the coupling studs of one of said first type of elements engaging recesses of another element of said first type in a releasable frictional interconnection;

toy building elements of a second type having an elongated body with a second type of coupling means, said second type of coupling means allowing establishing a releasable pivotal interconnection between two toy building elements of the second type, the coupling means of said second type not being directly interconnectable with the coupling means of said first type;

toy building elements of a third type, each of said third type of building element comprising coupling studs on an outer surface thereof allowing interconnection with recesses of toy building elements of said first type and having coupling means of the second type allowing interconnection with toy building elements of the second type, said outer surface of said third type of building element being further provided with a threaded hole for receiving a screw; and toy building elements of a fourth type, each of said fourth type of building element having recesses of toy building elements of said first type for receiving the coupling studs of said third type of building element in a releasable frictional interconnection and having a threaded screw receivable in said threaded hole of said third type of building element.

2. A toy building set according to claim 1 wherein the third type of elements (100; 200; 300; 400;) have a substantially box-shaped body, and that the coupling means (140, 122, 126, 128, 129, 130; 222, 226, 228, 230; 342, 344, 346; 440) of the second type extend beyond the contour of said box-shaped body.

3. A toy building set according to claim 1 wherein the first set of coupling means includes coupling studs (102; 202; 302; 402) arranged in parallel rows with a mutual modular distance (M) between the coupling studs (102; 202; 302; 402), wherein the screw connection is provided in the intersection point of the diagonals for a square with four coupling studs (102; 202; 302; 402) in the corners.

4. A toy building set according to claim 3 wherein the width of the first, second and third type of building elements (100; 200; 300; 400; 500; 1–9) is a whole multiple of the modular distance (M) of the coupling studs (102; 202; 302; 402).

5. A toy building set according to claim 4, wherein the width of the primary, secondary and tertiary building elements (100; 200; 300; 400; 500; 1–9) is twice the modular measure (M).

6. A toy building set according to claim 1 wherein the body of the third type of building element (100; 200; 300; 400) is box-shaped and the height of the box-shaped body of the third type of building element (100; 200; 300; 400) corresponds to the height of the box-shaped first type of building element (8, 9) without coupling studs.

7. A toy building set according to claim 6 wherein the height of the second type of building element (500) corresponds to the height of the box-shaped body of the third type of building element (100; 200; 300; 400).

8. A toy building set according to claims 1, wherein the third type of building element (100) has coupling studs (102) on the upper side, complementary coupling means (106, 108) on the underside, a first coupling part (140) at one end of the element and a coupling part (122, 126, 128, 129, 130) complementary therewith at the other end of the element.

9. A toy building set according to claim 8, wherein the first coupling part (140) is rotationally connected with the third element (100) about an axis transversely to the axis of rotation formed by interconnection of the second type of coupling means.

10. A toy building set according to claim 8 wherein the first set of coupling means including coupling studs (102; 202; 302; 402) arranged in parallel rows with a mutual modular distance (M) and the box-shaped third element (100) has a row of threaded holes (150) along two long sides, and that the distance between the threaded holes (150) corresponds to the modular distance (M) of the coupling studs (102).

11. A toy building set according to claim 8, the distance in the longitudinal direction of the third element (100) between the center of an arbitrary coupling stud (102) and the axis of rotation formed with the second type of coupling means (122, 126, 128, 129, 130, 140) is a whole multiple of half the modular distance (M) of the coupling studs (102).

12. A toy building set according to claim 11, wherein the distance between the axis of rotation and the adjacent pair of coupling studs (102) corresponds to three times half the modular distance (M).

* * * * *